United States Patent [19]

Ganz et al.

[11] 4,126,168

[45] Nov. 21, 1978

[54] MULTI-PURPOSE POCKET-SIZE CARRYING CASE

[75] Inventors: Joseph Ganz, Fairlawn, N.J.; Burt J. Siris, New York, N.Y.

[73] Assignee: Sirco International Corporation, Westchester, N.Y.

[21] Appl. No.: 846,839

[22] Filed: Oct. 31, 1977

[51] Int. Cl.[2] ..... A45C 1/06

[52] U.S. Cl. ..... 150/35; 150/39

[58] Field of Search ..... 150/35, 37, 38, 39, 150/40

[56] References Cited

U.S. PATENT DOCUMENTS

| | | | |
|---|---|---|---|
| 1,037,264 | 9/1912 | Kimmel | 150/35 |
| 1,561,343 | 11/1925 | Michaels | 150/38 |
| 2,405,379 | 8/1946 | Thomas | 150/35 |
| 2,578,390 | 12/1951 | Bastow | 150/35 |
| 2,876,819 | 3/1959 | Cohen | 150/35 |
| 3,262,478 | 7/1966 | Amsterdam | 150/35 X |
| 3,267,980 | 8/1966 | Bird | 150/35 |
| 3,856,063 | 12/1974 | Dengel | 150/35 |

*Primary Examiner*—Donald F. Norton

*Attorney, Agent, or Firm*—Robert E. Burns; Emmanuel J. Lobato; Bruce L. Adams

[57] ABSTRACT

A carrying case comprises three principal sections serially connected together such that the outer two can be folded inwardly over the center one to form a case of pocket size. One end section has a key compartment on the exterior side, and on the interior side is provided an inside compartment with a zipper closure for use as a change purse, and two inside pockets one disposed on either side of the inside compartment. The center section has an expandable compartment on the exterior side and a photograph compartment on the interior side. The other end section is provided with a series of credit card compartments on the exterior side and a photograph compartment on the interior side. A paper money compartment is formed between the interior and exterior sides for holding paper currency and the like. A closure strap is connected to one end section and is provided with a snap fastener for holding and maintaining the case in its folded condition.

10 Claims, 5 Drawing Figures

MULTI-PURPOSE POCKET-SIZE CARRYING CASE

BACKGROUND OF THE INVENTION

The present invention relates generally to portable carrying cases and more particularly, to a pocket-size case having plural compartments designed specially to accommodate different articles.

There are currently many types of carrying cases available though in general, such cases are designed for specific purposes and for carrying a limited number of articles. Some cases, such as wallets, have provision for carrying paper money and one or more other compartments for carrying photographs or credit cards. Conventional wallets are disadvantageous in that they do not have a sufficient number of compartments for carrying the many items a person normally wishes to carry and as a result, the extra items are either carried in the person's garment pocket or in another case.

Larger carrying cases, such as pocketbooks and shoulder bags, provide sufficient carrying space though are disadvantageous in that they are bulky and cannot fit in a garment pocket. These larger cases also suffer the drawback of being insufficiently compartmentalized with the attendant result that the numerous articles are simply stuffed in the case thereby making it difficult to locate and retrieve a specific article. Other cases, such as a billfold or key case, are designed specifically to hold one article and hence are disadvantageous in that a person must therefore carry several different cases in order to carry all of the standard and customary items. This results in placing different cases in different garment pockets and such is both bulky and uncomfortable.

SUMMARY OF THE INVENTION

It is therefore a primary object of the present invention to provide a multi-purpose pocket-size carrying case which overcomes the foregoing drawbacks and disadvantages.

It is another object of the present invention to provide a carrying case having a plurality of separate compartments which are configured to receive specific types of articles.

A further object of the invention is to provide a multi-purpose pocket-size carrying case of relatively simple construction yet which is rugged and durable in nature.

The above and other objects, features and advantages of the invention are accomplished by a carrying case composed of three principal sections serially connected together such that the outer two can be folded inwardly, over the center one, into a case of pocket-size. One end section has a key compartment on the exterior side and on the interior side is provided an inside compartment with a zipper closure for use as a change purse, and two inside pockets, one disposed on either side of the inside compartment. The center section has an expandable compartment on the exterior side and a photograph compartment on the interior side. The other end section is provided with a series of credit card compartments on the exterior side and a photograph compartment on the interior side. A paper money compartment is formed between the interior and exterior sides for holding paper currency and the like. A closure strap is connected to one end section and is provided with a snap fastener for holding and maintaining the case in its folded condition.

Having in mind the above and other objects, features and advantages of the invention that will be evident from an understanding of this disclosure, the present invention comprises a multi-purpose pocket-size carrying case as illustrated in the presently preferred embodiment of the invention which is hereinafter set forth in sufficient detail to enable those persons skilled in the art to clearly understand the function, operation and advantages of it when read in conjunction with the accompanying drawings.

DETAILED DESCRIPTION OF PREFERRED EMBODIMENT

Figure 1:
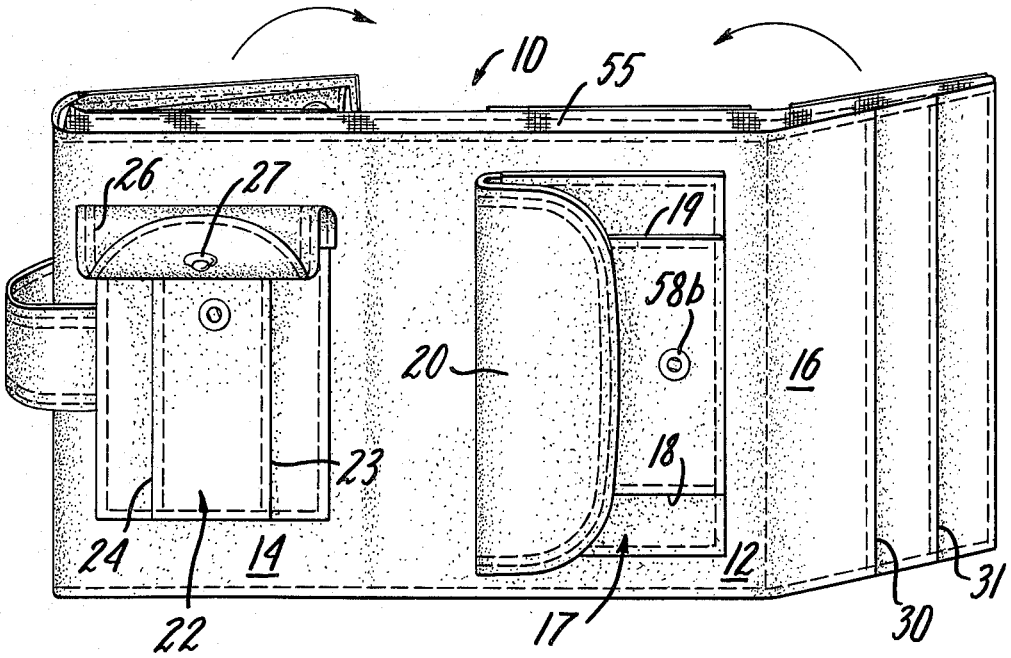
FIG. 1 is a perspective view showing the exterior side of the carrying case in its unfolded condition according to the present invention.
Figure 2:
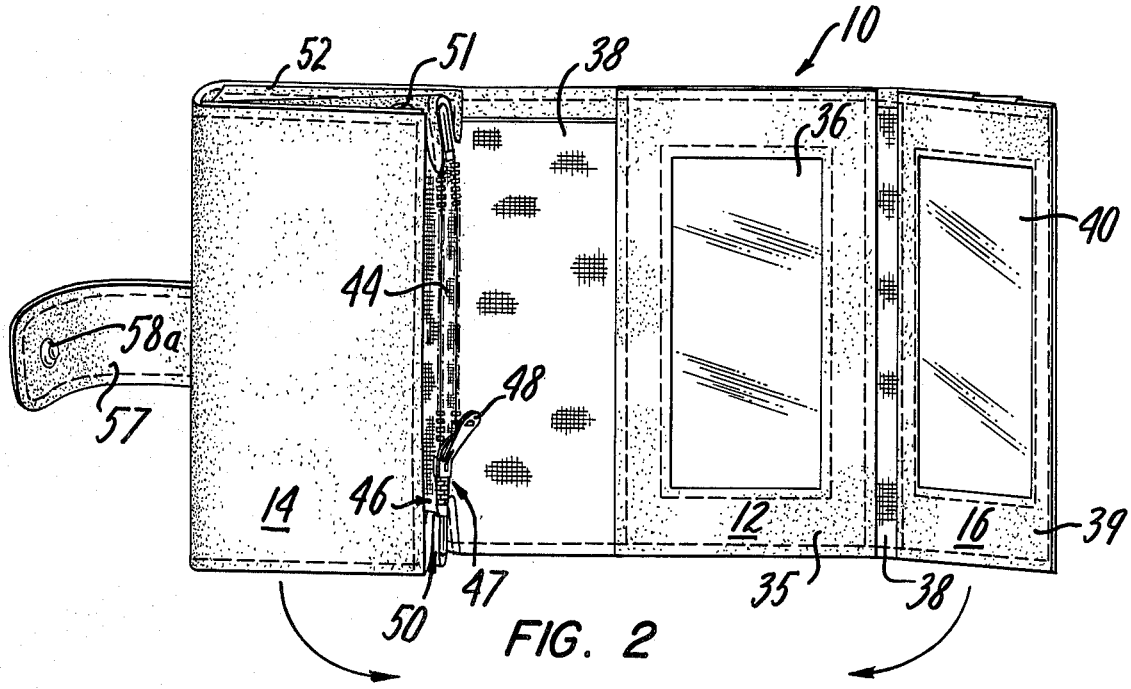
FIG. 2 is a perspective view showing the interior side of the carrying case in its unfolded condition.
Figure 5:
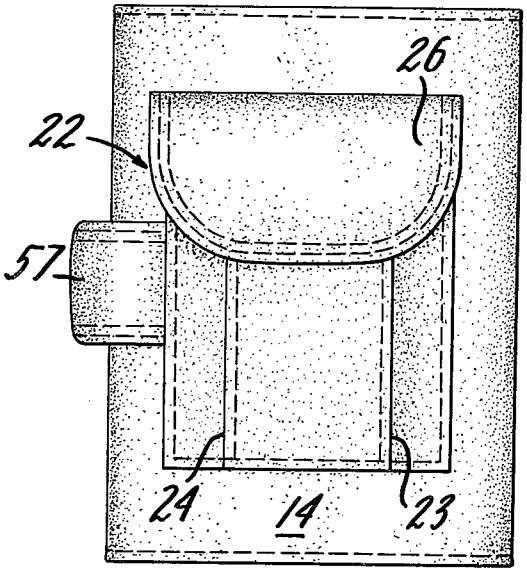
FIG. 5 is a perspective rear view of the carrying case in its folded condition.
Figure 4:
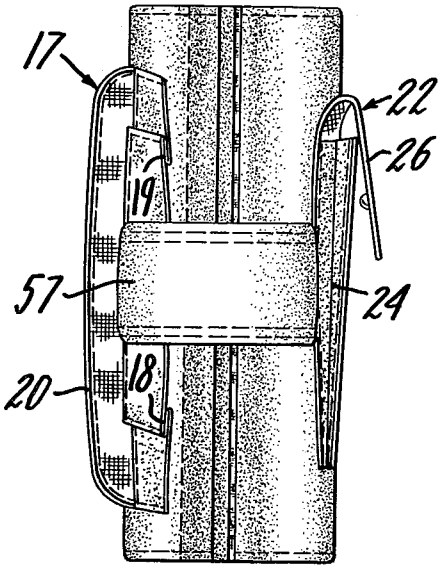
FIG. 4 is a perspective right side view of the carrying case in its folded condition.
Figure 3:
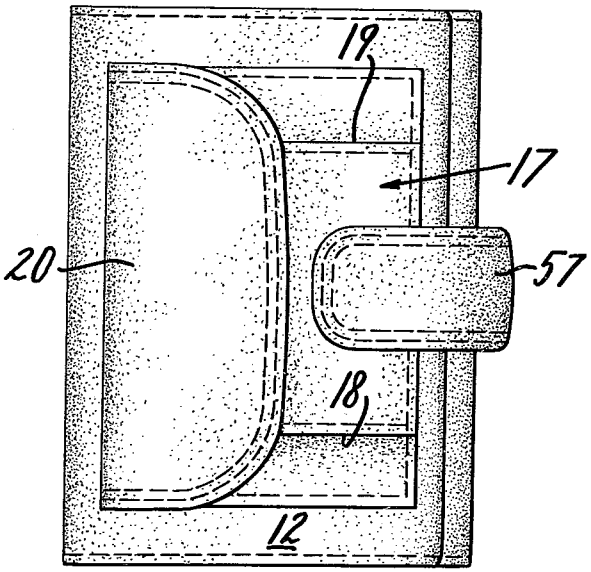
FIG. 3 is a perspective front view of the carrying case showing the same in its folded condition.

The carrying case is designated generally by the reference character 10 and is shown in substantially its fully unfolded condition in FIGS. 1–2 and in its folded condition in FIGS. 3–5. The case has three principal sections, a center section 12 and two outer sections 14 and 16 formed integrally with the center section 12 such that when the case is in its fully unfolded state, the three sections define a generally rectangular shape. The case can be formed of natural or synthetic leather, fabric or other suitable material, it being understood that the particular choice of materials is not a characteristic feature of the invention.

The exterior side of the case is best seen in FIG. 1 and for purposes of description, the longitudinal side of the case which is visible when the case is in its folded condition is referred to as the "exterior side" whereas the inner side which is concealed when the case is in its folded condition is referred to as the "interior side". For like purposes, one part of the case, when in its folded condition, is referred to as the "front" and the reverse part as the "rear" and such designations have been used for purposes of description only and not in any limiting sense. An expandable compartment 17 is attached to the exterior side of the center compartment 12 and this compartment is intended for storing miscellaneous items. The compartment 17 comprises a piece of material attached by stitching to the face of the section 12 and pleats 18, 19 are provided to permit expansion of the compartment to accommodate the desired articles. A cover flap 20 is provided with a snap fastener (not visible) for enabling ready opening and closing of the compartment.

In a similar fashion, a key compartment 22 is attached to the face of the end section 14 by stitching and this compartment is formed of a single piece of material having pleats 23 and 24 to enable expansion of the compartment to accommodate the desired number of keys. A cover flap 26 is provided with a snap fastener 27 to permit closing of the compartment. The construction of the compartments 17 and 22 is more apparent in FIGS. 3–5 and as seen in FIG. 4, the folded pleats 18 and 19 of the compartment 17 have sufficient overlap to permit expansion of the compartment. The pleats are sewn closed at their lowermost end remote from the cover flap and are stitched jointly with the stitching of the compartment to the face of the center section 12. The key compartment 22 is formed in a like manner.

On the other end section 16 is formed a set of credit card compartments 30 and 31 which are formed by overlapping strips of material and stitching them together. The credit card compartments are dimensioned to extend less than the height of a credit card or like object so that a portion of the card, when inserted in the compartment, is visible above the compartment line. The card compartments 30 and 31 are intended to be used for storing not only credit cards, but also calling cards, driver's license or any similar sized cards.

The interior side of the carrying case is shown in FIG. 2 which shows the reverse sides of the sections 12, 14 and 16. On this side, the sections 12 and 16 are similar and each is provided with a photograph compartment. The center section 12 has attached thereto a photograph compartment 35 in the form of a rectangular piece of material having a rectangular cutout at its center beneath which is stitched a transparent plastic window 36. The material forming the compartment 35 is stitched along the righthand edge to a backing material 38 as well as along the top and bottom edges thereby enabling insertion of a photograph or similar item into the compartment along the open lefthand edge. In like fashion, a photograph compartment 39 is formed on the end section 16 and is provided with a transparent window 40.

The interior side of the case section 14 is provided with an inside compartment 44 interposed between inside pocket compartments 46 and 47. The inside compartment 44 is composed of two pieces of material sewn together at their base and sides and joined at their top by a zipper closure. The zipper closure includes conventional stringer tapes sewn to the top marginal edges of the two pieces of material and along which rides a zipper tab 48. The inside compartment 44 comprises a change purse for storing loose change, tokens and similar items. The inside compartment 44 is attached by rivets 50, 51 to pleated web 52 inserts at each end of the section 14, the inserts being employed to provide the needed thickness for the compartment 44 and the inside pockets 46 and 47. The web inserts are sewn to the material making up the end section 14 and by such a construction, the outer sides of the compartment 44 each form one of the sides of the inside pockets 46 and 47.

The exterior and interior sides of the case are attached together in such a fashion so as to form a paper money compartment 55 between the two sides. More particularly, as seen in FIG. 1, the two sides are joined along their base by stitching as well as along the outer edges of the end sections 14 and 16 though remain unattached along their top. In this fashion, the compartment 55 extends along the entire length of the case and is readily accessible from the top for use in storing paper currency. If desired, the compartment 55 can be lined with suitable lining material.

A closure strap 57 is attached to the end section 14 adjacent the key compartment 22 and is provided at its distal end with the male part **58*a* of a fastener snap 58. The expandable compartment 17 is provided with a female part 58*b* of the fastener snap 58 and by such an arrangement, when the case is folded to its fully folded state, the male part 58*a* may be snapped into the female part 58*b* thereby maintaining closed the case. As evident from the drawings, the case is constructed such that the end section 16 can be folded inwardly into abutment with the interior side of the center section 12 and thereafter, the end section 14 can likewise be folded inwardly into abutment with the folded over section 16 to place the case in its folded condition. The respective folding directions are indicated by arrows in FIGS. 1 and 2**. When in its folded condition, the case is of pocket size so that it may be inserted and carried within a garment pocket.

In view of the foregoing, it can be appreciated that the case of the invention has diverse application and can be used for a variety of purposes. Notwithstanding the multi-purpose nature of the case, it is of simple and durable construction and configured to be of pocket size.

Many modifications and changes to the case will become apparent to those ordinarily skilled in the art and the present invention is intended to cover all such obvious modifications and changes which fall within the spirit and scope of the invention as defined by the appended claims.

We claim:

1. A pocket-size carrying case comprising: a case center section, and two case end sections integral with said center section at opposite ends thereof and both being foldable so as to lie over said center section to define the folded condition of the carrying case in which all sections are folded one over another; said center and end sections jointly forming opposed exterior and interior longitudinal case sides defining therebetween a paper money compartment for storing paper money and the like; means defining a key compartment on the exterior side of one of said end sections for storing keys; means defining an expandable compartment on the exterior side of said center section; and means defining credit card compartments on the exterior side of the other of said end sections for storing credit cards and the like.

2. A pocket-size carrying case according to claim 1; further including means defining a photograph compartment on the interior side of said other end section for storing and displaying a photograph and the like.

3. A pocket-size carrying case according to claim 1; further including means defining a photograph compartment on the interior side of said center section for storing and displaying a photograph and the like.

4. A pocket-size carrying case according to claim 1; further including means defining an inside compartment on said one end section between the interior and exterior sides thereof for storing monetary change and the like, said inside compartment having a closure to enable opening and closing thereof.

5. A pocket-size carrying case according to claim 4; further including means defining two inside pockets on said one end section disposed respectively on opposite sides of said inside compartment between said interior and exterior sides.

6. A pocket-size carrying case according to claim 1; further including means defining a photograph compartment on the interior side of said other end section for storing and displaying a photograph and the like; means defining a photograph compartment on the interior side of said center section for storing and displaying a photograph and the like; and means defining an inside compartment on said one end section between the interior and exterior sides thereof for storing monetary change and the like, said inside compartment having a closure to enable opening and closing thereof.

7. A pocket-size carrying case according to claim 6; further including means defining two inside pockets on said one end section disposed respectively on opposite sides of said inside compartment between said interior and exterior sides.

8. A pocket-size carrying case according to claim 6; further including a closure strap attached at one end to the exterior side of said one end section, and fastening means having one part on the other end of said closure strap and a complementary part on said center section for releasably fastening said closure strap to hold the carrying case in its folded condition.

9. A pocket-size carrying case according to claim 6; wherein said key compartment includes a cover flap for closing said key compartment, and fastening means for releasably fastening said cover flap to maintain said key compartment closed.

10. A pocket-size carrying case according to claim 6; wherein said expandable compartment includes a cover flap for closing said expandable compartment, and fastening means for releasably fastening said cover flap to maintain said expandable compartment closed.

* * * * *